United States Patent [19]

Akkala

[11] Patent Number: 5,035,103

[45] Date of Patent: Jul. 30, 1991

[54] SELF SEALING VACUUM VENT AND DOME PROCESS

[76] Inventor: Walter I. Akkala, 638 Sycamore Sq., Lady Lake, Fla. 32159

[21] Appl. No.: 532,390

[22] Filed: Jun. 4, 1990

[51] Int. Cl.[5] ..... B65B 31/00

[52] U.S. Cl. ..... 53/434; 53/479; 53/88; 53/512

[58] Field of Search ..... 53/88, 403, 405, 408, 53/427, 432, 433, 434, 469, 479, 510, 511, 512, 390

[56] References Cited

U.S. PATENT DOCUMENTS

| | | | |
|---|---|---|---|
| 2,541,674 | 2/1951 | Snyder . | |
| 2,576,322 | 11/1951 | Waters | 53/88 |
| 2,691,474 | 10/1954 | Olson | 53/479 |
| 2,708,067 | 5/1955 | Paton . | |
| 2,916,059 | 12/1959 | Wong | 53/512 X |
| 3,108,881 | 10/1963 | Shaw et al. . | |
| 3,140,185 | 7/1964 | Pinckney . | |
| 3,149,772 | 9/1964 | Olsson . | |
| 3,216,172 | 11/1965 | Piazze | 53/512 X |
| 3,216,832 | 11/1965 | King . | |
| 3,261,140 | 7/1966 | Long et al. . | |
| 3,314,804 | 4/1967 | Kosikowski | 53/405 |
| 3,415,032 | 12/1968 | Woller | 53/432 |
| 3,469,364 | 9/1969 | Bischoff | 53/434 X |
| 3,545,983 | 12/1970 | Woods . | |
| 3,851,437 | 12/1974 | Waldrop et al. . | |
| 3,869,842 | 3/1975 | Verbeke . | |
| 3,928,938 | 12/1974 | Burrell | 53/434 |
| 4,510,733 | 4/1985 | Hansen et al. | 53/434 |
| 4,534,152 | 8/1985 | Akkala . | |
| 4,921,137 | 5/1990 | Heijenga | 53/479 X |

FOREIGN PATENT DOCUMENTS

| | | | |
|---|---|---|---|
| 2124995 | 2/1984 | United Kingdom | 53/511 |

*Primary Examiner*—John Sipos

*Attorney, Agent, or Firm*—Julian C. Renfro

[57] ABSTRACT

This invention relates to the vacuum packaging of products and involves the use of a heat sealable thermoplastic bag in conjunction with a vacuum dome having a sealing edge disposed around its periphery and being connected to a source of vacuum, the thermoplastic bag being entirely closed except for an integral flat vent passage disposed at one peripheral location on the bag. One half of the vent passage is made up of material from one portion of the bag, and the other half of the vent passage is made up of a precisely equal amount of material from an opposite portion of the bag, such that the interior surfaces of said vent passage can tend to adhere together. The novel method in accordance with this invention comprises the steps of placing the thermopalstic bag in a supportive device having a desired configuration, placing the vacuum dome over the vent passage so the vent passage protrudes into the interior of the vacuum dome, with the peripheral edge of the dome in contact with bag portions surrounding the vent passage, reducing the pressure inside the dome so as to cause the egress of air from the interior of the bag out through the vent passage, thereafter removing the dome from contact with the bag, with the sidewalls of the vent member sealing together temporarily, and then taking the final step of heat sealing the opening of the vent passage to effectively prevent the return of air to the interior of the bag.

9 Claims, 2 Drawing Sheets

FIG 1
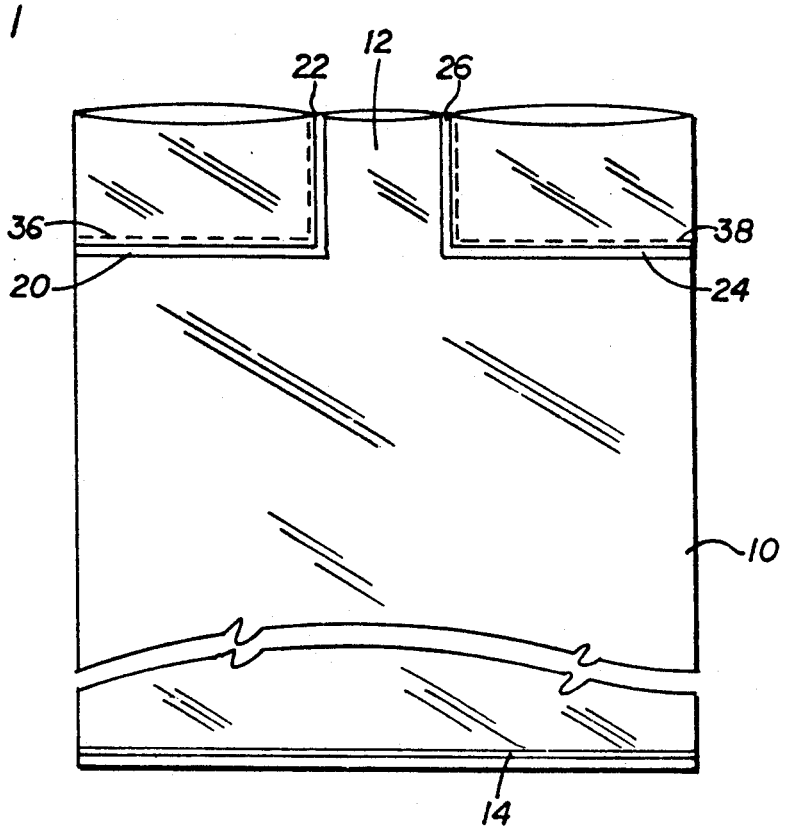
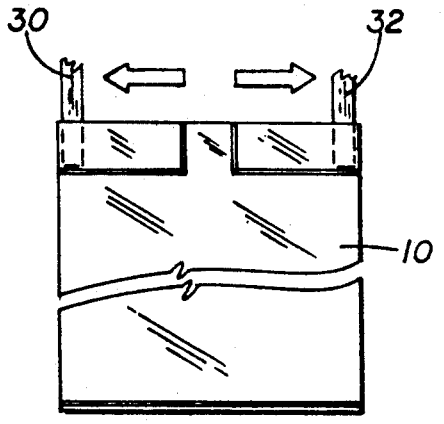
FIG 2
FIG 3
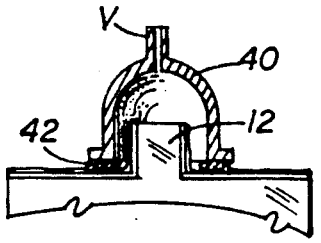
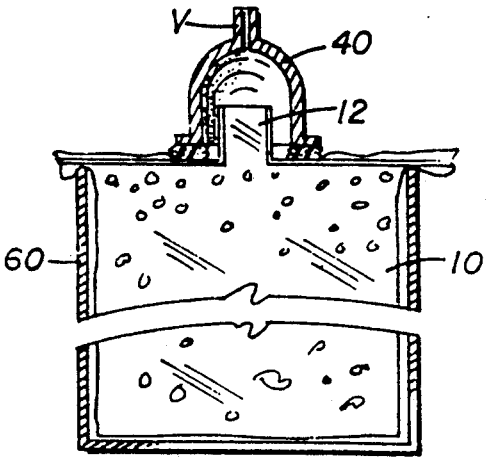
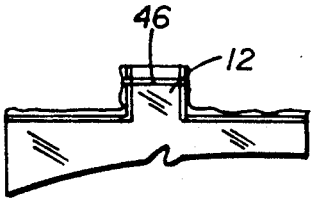
FIG 4
FIG 5

SELF SEALING VACUUM VENT AND DOME PROCESS

RELATIONSHIP TO PREVIOUS DOCUMENTATION

This invention bears a definite relationship to an invention disclosure submitted to the U.S. Patent and Trademark Office as a Disclosure Document on Feb. 21, 1989, which was accorded Disclosure Document 220404.

BACKGROUND OF THE INVENTION

It is well known to vacuum package perishable food as well as certain other products in order to exclude oxygen, moisture, dust and various forms of contamination. One reason for vacuum packaging is that in the case of a perishable food product, such product will degrade quickly in the presence of oxygen, so by removing air during the packaging of the product, its shelf life can be greatly increased.

Another reason for vacuum packaging is that an evacuated package containing a compressible product will displace a smaller volume than a non-evacuated package, thus enabling more economical shipping and storage costs.

After the food, the precision instruments, or the other item to be protected has been placed in a bag or package, some patentees have taught the placement of such packages in a vacuum chamber in order to withdraw the air through a vent in the package. After air removal, the vent is sealed. Examples of this particular technology are the Woods U.S. Pat. No. 3,545,983, entitled "Method of Deoxygenating and Packaging of Food Products," which issued Dec. 8, 1970, and the Waldrop et al U.S. Pat. No. 3,851,437, entitled "Receptacle Evacuation Apparatus and Method," which issued Dec. 3, 1974.

In pursuing techniques of this type, the oxygen content in food packages, for example, may be is reduced down to 1½ percent or less by initially stripping a portion of the oxygen by exposing the food to flowing inert gas before it is placed in the packages. After this, the packages are placed in a vacuum chamber, and the oxygen-containing atmosphere is withdrawn, so as to cause fluid flow from each of the packages. When the chamber reaches a certain level of vacuum, dictated by the desired package hardness, the package may be hermetically sealed by sealing jaws in the chamber. Other techniques for sealing the packages are of course available.

In packaging by utilizing techniques of this type, it is known to place the packages in shaping devices, so that the completed packages will have a certain desired contour . Inasmuch as the contents of some packages initially contain air at atmospheric pressure, it is important to place such packages in devices preventing the expansion and subsequent bursting of the package when placed inside the vacuum chamber, as the pressure in the chamber is lowered.

Other patentees have taken a different route, with the King U.S. Pat. No. 3,216,832 entitled "Suction Packaging Method" involving an improvement upon the use of packaging constituted by lower and upper films of stretch wrap material. The items to be packaged are placed on the lower film, after which the air is withdrawn from the package. Such packages are sealed together peripherally after the air has been withdrawn, so as to draw the film into snug engagement with the product. In this particular patent to King, the patentee taught a preshaping of the bottom film to the product, so that there is less space to be evacuated, so that the film is drawn more readily into contact with the product, and so that less residual air is enclosed.

A somewhat different packaging technique involves a flexible package in which the product is placed, with a probe being inserted into the package through an open end of the package. The end of the package closes around the probe, after which the gases are removed from the package through the probe. Subsequently the probe is removed, and the package heat sealed.

My U.S. Pat. No. 4,534,152 entitled "Self Sealing Vacuumed Package," which issued Aug. 13, 1985 represented an advance in the art by teaching a method for the vacuum packaging of heat sensitive powdered products, perishable cheese products, and the like. Such product is placed in a thermoplastic bag, in the end of which I utilize a tortuous vent passage. The package is then placed in a supportive container having a two section cover, through which the tortuous vent passage protrudes. In this way, the bag is prevented from expanding and bursting when subjected to a vacuum.

The supportive container is then placed in a vacuum chamber such that the air inside the package is withdrawn through the vent passage. The vent passage collapses at such time as the vacuum chamber has been opened to atmospheric pressure, with such collapse of the vent passage forming a temporary seal, thus giving ample time for the package to thereafter be permanently sealed.

It was in an effort to improve still further upon these techniques that the present invention was evolved, which makes possible the use of a vacuum dome in achieving the vacuum packaging of a product, thus making the employment of a vacuum chamber unnecessary in many instances.

SUMMARY OF THE INVENTION

The method of vacuum packaging products without necessitating the use of a vacuum chamber in accordance with this invention involves a substantially filled heat sealable thermoplastic bag utilized in conjunction with a vacuum dome. The vacuum dome has a sealing edge disposed around its peripheral portion to be brought into contact with the bag to be evacuated, with an upper part of the dome being connected to a source of vacuum.

The thermoplastic bag is entirely closed except for an integral flat vent passage disposed at one peripheral location on the bag, one half of the vent passage being made up of a precisely equal amount of material as used on the opposite half of the vent passage. The vent is of course sized to the vacuum dome with which it is to be used. Because of this highly advantageous arrangement I utilize, the interior surfaces of the vent passage will adhere closely together at such time after the vacuum has been drawn and atmospheric pressure returns to the dome. This gives the user or operator ample time to create the heat seal across the vent, without having to worry about the re-entry of atmospheric air into the bag.

The thermoplastic bag may in some instances be placed in a supportive device having a desired configuration, after which the vacuum dome is placed over the vent passage such that the vent passage protrudes in a closely fitting relationship into the interior of the vacuum dome, with the peripheral edge of the dome in contact with bag portions surrounding the vent passage. The supporting device is particularly useful when dealing with bulky items, or when a specific configuration of the final product is desired.

The pressure inside the dome is then reduced, so as to cause the egress of air from the interior of the bag out through the vent passage. After virtually all of the air has been removed from the bag, the source of vacuum is removed from the dome and the dome removed from contact with the bag, with the sidewalls of the vent member sealing together closely. The final step is then taken to heat seal the halves of the vent passage together, to effectively prevent the return of air to the interior of said bag.

Advantageously, the vent passage need not be heat sealed immediately, for I have found that the internal portions or halves of the vent passage inherently stick together, excluding atmospheric air for a rather substantial period of time.

It is therefore a primary object of my invention to provide a novel, low cost method for the vacuum packaging of food and other products so as to exclude air, moisture and other contaminants, with this method not requiring the use of a vacuum chamber, nor any other expensive machinery.

It is another object of my invention to provide a novel vent for a package, usable with either of two novel vacuum domes, thus simplifying the process of vacuum packaging of food products and the like, with this process not requiring the use of any expensive equipment or machinery.

It is still another object of my invention to provide a novel process involving the use of a highly advantageous vent for a vacuum package, from which air may be withdrawn by the use of portable equipment, thus making it possible for the operator to go to the product in a storage area, as opposed to having to move the product to a vacuum chamber, as was previously necessary.

It is yet still another object of my invention to reduce the size of bulky compressible products, thus to save on shipping and storage costs.

These and other objects, features and advantages will become more apparent as the description proceeds.

BRIEF DESCRIPTION OF DRAWINGS

FIG. 1 is a side elevational view showing a flat thermoplastic bag equipped with a novel vacuum vent in accordance with this invention;

FIG. 2 is a view to a smaller scale, showing the spreader means utilized in accordance with this invention in order to assure a degree of tension applied to the portion of the thermoplastic bag from which the vent is to be created by the application of heat seal means;

FIG. 3 is a side elevational view showing the vacuum vent extending into the dome used to remove atmospheric air from the thermoplastic bag;

FIG. 4 is a view of my novel vent, to which the final seal has been applied;

FIG. 5 reveals a product-filled plastic bag that has been placed in a container, with the dome in place over the novel vent, ready for the application of a vacuum;

Figure 10:
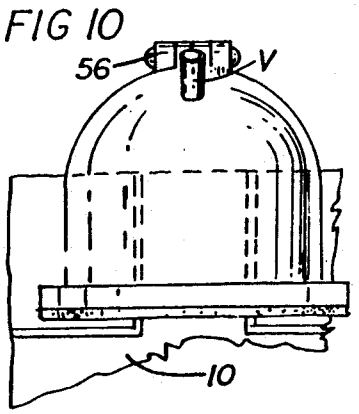
Figure 9:
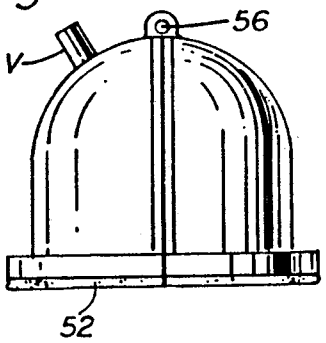
Figure 8:
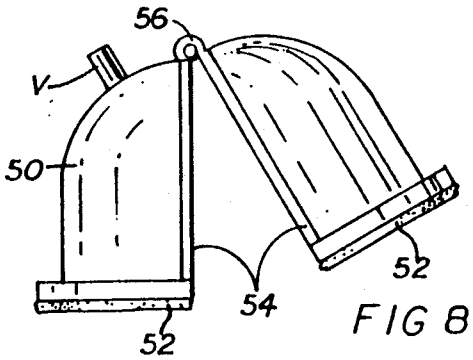
Figure 13:
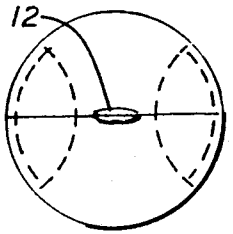
Figure 12:
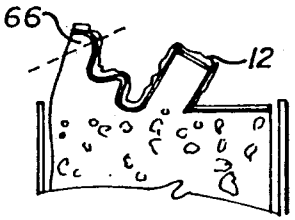
Figure 11:
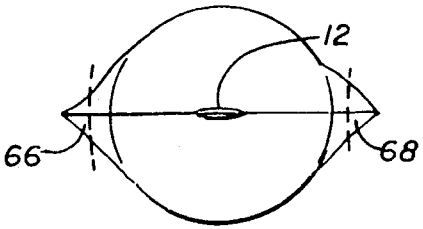

FIGS. *7a* through *7f* are a series of related views , revealing the steps of a procedure that can be followed in the vacuum packaging of foodstuffs and other materials as well;

FIG. 8 is a side view of my novel split dome, with the split dome opened;

FIG. 9 is a side view with the split dome closed;

FIG. 10 represents a view utilized in order to reveal certain details of the split dome hinge;

FIG. 11 is a top view of the a plastic bag showing the vent in a central location, and the corner locations at which a cut could be made in order to permit product testing;

FIG. 12 is a side view of bag showing excess area of bag where a sample could be taken; and FIG. 13 is a top view of area where samples may be taken after a cut has been made.

DETAILED DESCRIPTION

The method of vacuum packaging products in accordance with this invention involves the use of a thermoplastic bag 10, as depicted in FIG. 1, into which is to be placed a food product, a precision instrument, or other such item that is to be protected from oxygen, moisture and dust. For that reason I use thermoplastic material constructed to utilize an oxygen barrier, such oxygen barrier being needed in order to prevent the migration of atmospheric oxygen into the interior of the bag through the sidewalls of the bag.

Although food products or precision instruments are typically placed in the bag, it is possible to utilize the techniques taught herein in connection with the packaging of bulky, non-perishable items, which are to be placed in a compressed state in order to save space in shipping.

As will be discussed to some extent hereinafter, a vent 12 is formed in an upper portion of the bag 10, and a seal 14 is utilized across the bottom of the bag.

Upon the bag being filled with the selected product, I utilize a vacuum dome over the vent 12 of the bag, to which dome is connected a tube that is in turn connected to the vacuum source. A typical dome is shown at 40 in FIG. 3, and by the use of such a vacuum dome, practically all of the air can be removed from the bag, thus obviating the use of a vacuum chamber. Then, after the vacuum effort has been concluded, and the dome removed from the vent, the vent can be sealed shut by the suitably concentrated application of heat, such as by the use of a simple ribbon heat seal, so as to enable the product in the bag to be preserved in a satisfactory manner for a long period of time.

Because of the care taken in the creation of the free standing vent utilized in accordance with this invention, it can be expected that the sides of the vent will adhere together for a sufficient interval of time that an attendant or operator can seal the vent by the suitable application of a heat seal, without any threat of the entry of air into the bag during the preparation leading up to the creation of the heat seal across the vent.

I can use either of two different types of vacuum domes, depending on the specific configuration of the vent, and the details of the construction and use of these domes will be discussed at length hereinafter.

Also, it is to be noted that my invention is of such a nature that it can be practiced by either an individual, or by a large corporation, and the procedures involved in each instance will later be described.

Returning now to a further consideration of FIG. 1, it will be noted that vent 12 is defined in a rectangularly configured upper portion of the thermoplastic bag 10. A top seal 20 extends from the left edge of the bag as viewed in FIG. 1, to a location relatively near to the vertical centerline of the bag, where the seal turns 90 degrees so as to form the left edge 22 of the vent 12. The top seal 24 extends from the right edge of the bag as viewed in FIG. 1, across the top of the bag and to a location relatively near to the vertical centerline of the bag, where the seal turns 90 degrees so as to form the right edge 26 of the vent 12. The vent 12 defined between the heat seals 22 and 26 represents the means by which the atmospheric air can be rapidly and effectively removed from the bag.

Although there are obviously other ways for forming a vent on the bag, one particularly uncomplicated procedure involves the use of so-called impulse wires configured into the appropriate geometrical shape, by the use of which the seals 20, 22, 24 and 26 can be created at the same time. A type of clamping fixture is used, on one active surface of which is a suitably configured set of impulse wires of resistive material. The impulse wires are covered with Teflon cloth, through which cloth the heat generated at the time current flows through the wires can readily pass. A firm backer is utilized on the other active surface of the fixture. Therefore, when the bag has been firmly clamped between the two active surfaces of the fixture, an electrical impulse is caused to flow through the impulse wires. The flow of electric current through the substantial resistance offered by the impulse wires is such that rapid heating takes place, which heating causes the desired seals to be effectively formed at the selected locations on the thermoplastic bag. As is obvious, the impulse wire array would be designed to coincide with the configuration desired to be brought about by the heat seals that are created on the thermoplastic material. This of course is what was done with regard to the embodiment of FIG. 1.

In order to assure that the vent is configured in the precisely desired manner, I prefer to utilize spreader means 30 and 32 in the manner illustrated in FIG. 2, that engage opposite sides of the bag, and spread the sides of the bag apart. One of the spreader means can be fixed, and the other one movable. Because of the sides of the vent being placed under a degree of tension by the spreader means, upon the impulse wires being used, it can be assured that equal amounts of plastic material are utilized on both sides of the vent being formed. It is important that the same amount of thermoplastic material be utilized in the creation of both sides of the vent 12, if the sides of the vent are to be expected to adhere together after the dome has been removed.

If desired, the unneeded portions of the upper portion of the bag can be trimmed away, such as along the dashed lines 36 and 38, shown by FIG. 1 to be located around the exterior edges of the sealed portions, such that the vent will be sharply defined. Upon that being done, the atmospheric air can be removed through the vent by a single piece dome 40, in the manner depicted in FIG. 3. It will be noted in FIG. 3 that the free standing vent 12 extends into the interior of the dome.

In accordance with this invention, one part of the dome 40 is equipped with a fitting V adapted to be connected to a source of vacuum, as mentioned hereinbefore. To the fitting V a tube of suitable size is connected, with the other end of of the tube being connected to the vacuum source. The major opening of the dome is equipped with a carefully prepared sealing edge 42 that extends entirely around the periphery of the opening. The sealing material is preferably made from closed cell foam rubber.

After the vacuum effort has been concluded, the dome is removed from the vent 12, and then a heat seal 46 is created across the vent, as shown in FIG. 4, with this heat seal preferably being created by the use of impulse wires of the previously described type.

On the other hand, if the trimming away of the bag portions on each side of the vent cannot readily be accomplished, then a two piece dome 50 of the type depicted in FIGS. 8 through 10 can be effectively utilized. This latter type dome will be discussed hereinafter.

Turning now to FIG. 5, it will there be seen that I have illustrated a container 60 of a desired configuration, in which is placed a thermoplastic bag 10 of the type discussed hereinbefore, that contains foodstuff, bedding material, or the like. As is obvious, the bag may contain any of a wide variety of products that are to be protected from oxygen, moisture and dust.

The container 60 is particularly useful for causing the bag to attain a certain configuration as air is removed therefrom, although the use of a container is also indicated when the item being packaged in the thermoplastic bag is of a particularly bulky and/or unwieldy nature, which is to be compressed into a smaller space for reasons of minimizing storage and/or shipping requirements. In the instance depicted in FIG. 5, the vent 12 is cleanly defined, making possible the use of a one-piece dome 40 of the type depicted in FIG. 3.

Figure 6:
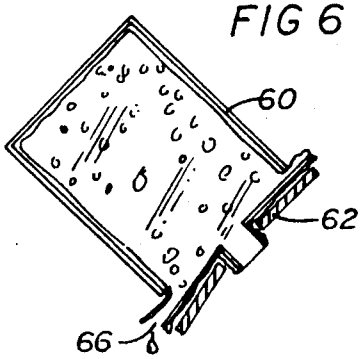
FIG. 6 shows the container tilted to drain excess fluid out of the product.
Figure 7F:
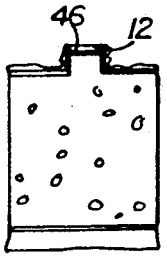
Figure 7E:
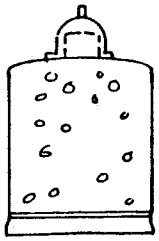
Figure 7D:
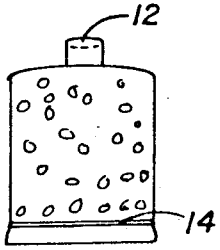
Figure 7C:
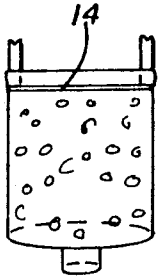
Figure 7B:
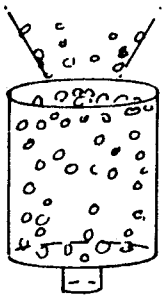
Figure 7A:
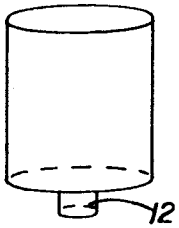

From time to time it becomes necessary or desirable to remove excess fluid from the bag, and in order that this may be accomplished, the container 60 and the bag 10 within are tilted in the manner shown in FIG. 6. In this instance, a toroidally shaped, rigid or semi-rigid cover member 62 is utilized to hold the product in the bag in the desired relationship. A cut 66 is made in the lower corner of the bag, the fluid drained out, and the opening resealed.

The thermoplastic bag 10 may have been made of two equal halves, with its edges sealed, or out of tube stock which is extruded, such that when a seal is extended across the bottom, a bag is created.

I have found that either of two rather different procedures for filling the bag may be resorted to, and will now be described.

Reference is now made to a series of related views, FIGS. *7a* through *7f*. In accordance with what may be regarded as a first procedure, an open-bottom bag already equipped with a vent at the top is initially turned upside down, as can be seen in FIG. *7a*. Such bag may for example rest in a suitably configured container. In this illustrated instance, the vent 12 is pointing downwardly.

As illustrated schematically in FIG. *7b*, the bag is then filled through the upturned bottom of the bag. The bottom of the bag is closed by heat sealing means, as depicted in FIG. *7c*, which may or may not entail the use of means to stretch the bottom of the bag as the heat seal is being created. Upon the seal 14 being completed, the bag is then reinverted, or in other words, is turned right side up, as depicted in FIG. *7d*, and a vacuum dome 40 in accordance with this invention is placed around the vent, as will be seen from FIG. *7e*. I prefer to reinvert the bag before drawing a vacuum by the use of the vacuum dome.

In FIG. *7e*, after a vacuum has been maintained for a sufficient length of time, the source of vacuum is removed from the dome 40, and then the dome is to be removed from contact with the vent. As is obvious, the two piece dome 50 could have been used in this instance, but such is really unnecessary when the vent 12 is distinctly defined.

As shown in FIG. *7f*, the vacuum dome has been removed, and it is to be noted that in accordance with an important aspect of this invention, there is a definite tendency for the sides of my novel vent 12 to adhere together and to exclude the re-entry of air at such time as the dome has been removed. This is because I have carefully constructed the vent to utilize equal amounts of material on both sides of the vent passage, as mentioned hereinbefore.

The sides of the vent passage can be expected to lie entirely flat, with no wrinkles, folds or any other aberrations that would serve to admit air. This of course affords the operator ample opportunity to create the heat seal 46 across the vent, without worrying about the intrusion of air from the atmosphere.

A procedure to be followed in loading a bag, that is an alternative to the foregoing, involves the utilization of an open-top bag, in which no vent had been earlier created. The bag is supported by a suitable means, and then the food item(s), precision instruments, or other such components are inserted into the bag. This having been accomplished, the vent is created in what used to be the open end, by the use of the suitably configured impulse wires, as was described in conjunction with the embodiment of FIG. 1.

The integral flat vent passage 12 is typically disposed at a preferred peripheral location on the bag, such as was illustrated in FIG. 1 and certain other figures. One half of the vent passage may in some bag constructions be made up of material forming one side of the bag, and the other half of the vent passage made up of a precisely equal amount of material from the other side of the bag, such that the interior surfaces of the vent passage will be free of folds or wrinkles, and can tend to adhere together. This tendency of the two sides of the vent passage 12 to adhere together is most important, for at the time the vacuum producing means is removed prior to the application of a heat seal, it is very undesirable for any air to enter the bag through the vent passage 12. The sidewalls of the vent passage 12 tend to adhere together due to the difference of atmosphere on the outside and the inside of the thermoplastic bag, and this gives the operator sufficient time to take the final step of heat sealing the opening of the the vent passage as shown in FIG. 2.

I am not limited to the use of the single piece dome depicted in FIGS. 3 and 5, for as earlier indicated, I can also use a two piece dome 50, involving two substantially equal halves hinged together, as depicted in FIGS. 8 through 10. On all active edges of the two piece dome I utilize closed cell foam rubber, to assure against air leaks. In FIG. 8 it will be seen that I have used closed cell foam rubber 52 around the lower peripheral edges of the two piece dome, as well as closed cell foam rubber along abutting vertical edges 54, where the two halves of the dome are intended to come into firm contact with the thermoplastic bag during the removal of air therefrom.

In FIGS. 9 and 10 it will be seen that I have depicted the port V to which the hose attached to the source of vacuum is to be connected, and I have also shown the hinge 56 that serves to hold the two substantially identical halves of the dome 50 together.

An advantage of utilizing the two piece dome 50 is of course the type of bag with which it may be used. A one-piece dome in effect requires a discrete vent passage, standing apart from the rest of the bag or container, to permit a sufficient entry of the vent passage into the interior of the dome. In contrast, in the instance of the use of a two piece dome 50, a bag of the type illustrated in FIG. 1 may be satisfactorily dealt with, wherein the vent is still attached to the parts of the bag on each side of the vent. In other words, the two piece dome can be used even though the vent is defined only by the use of a pair of seams made on each side of the intended location for the vent.

Thus it is to be seen that the material remaining on each side of the vent need not be removed, for the two piece dome 50 can readily be caused to enclose the vent 12, despite the presence of the material remaining on each side of the vent.

With regard to vent details, if the plastic bag used is of a size to fit inside a 50 gallon drum or barrel, which bag may be approximately 36 inches wide and 60 inches long if laid flat, a free standing vent approximately two inches wide and approximately three inches long is the appropriate size in most instances.

If the bag is say 24 inches wide, a vent one inch wide is adequate, whereas if the bag is say 6 inches wide, a vent ½ inch wide is adequate.

In each instance with the utilization of different sized, free standing vents, the dome should always be correspondingly sized so as to effect a close fitting relationship with the vent.

In some instances it is required by regulating agencies that the vacuum packaged product be tested after a certain length of time. As an example, the Department of Agriculture requires that certain cheese products be checked for moisture content from time to time.

With reference to FIG. 11, it will there be seen that I have shown a plastic bag equipped with a central free-standing vent 12, as well as two substantially oppositely disposed corner locations 66 and 68, in either of which a cut could be made for taking test samples of the product, or for the draining off of excess fluids. By noting adjacent FIG. 12, it will be seen that I have shown corner location 66, where the user has decided to make the cut so that the test sample can be taken. As is obvious, upon the test being completed or the excess fluid poured off, the user then reseals the corner location 66.

With reference to FIG. 13, it is to be noted that two suitable locations on a bag are shown, from either of which samples could be taken some days or weeks, or even months after the original vacuum packaging of the product. In dashed lines in FIG. 13 I have indicated the particular locations where it is possible for samples to be taken. Therefore, upon the selected corner being brought to a location corresponding to the position shown in FIG. 12, a cut of suitable size can be made, and a sample taken.

The inspector can for example insert a sampling probe into the opening created by the corner being cut off. After the sample has been taken, the corner where the cut had been made can be sealed closed.

By having made the initial seal high on the vent 12, at a location comparatively far from the bag, it will be but a simple matter to re-prepare the bag for storage or shipping. That this may be accomplished, the original heat seal is cut away, and the vacuum dome is again placed on the vent. The vacuum is drawn again, until the desired degree of evacuation of the bag has been accomplished. The vacuum hose is then removed from the dome, and the dome is removed from its surrounding location on the vent.

As explained hereinabove, the sides of the vent tend to adhere together for some period of time, giving the user an ample opportunity to establish a new heat seal across the vent, thus to prevent the re-entry of atmospheric air into the bag.

It is to be realized that my novel, self sealing vent has applications other than for use with a vacuum dome. For example, in the instance of certain products contained in a thermoplastic bag, such as newly manufactured cheese curds, if a vacuum dome were placed over the vent passage and a vacuum drawn, the product might tend to be sucked into the vent passage, blocking same. Accordingly, in some instances it is desirable to use a vacuum chamber for removal of the air from the bag, for in a vacuum chamber environment, there is no particular tendency for the product to move up so as to block the vent.

It is not to be inferred from the preceding paragraph that the vacuum dome cannot be widely used in the packaging of cheese products, for the dome manifestly has extensive applications. It is just in instances where the cheese product has a particularly rubbery texture that the use of the vacuum chamber is preferable to the vacuum dome.

I claim:

1. The method of vacuum packaging products involving a substantially filled heat sealable thermoplastic bag utilized in conjunction with a vacuum dome having a sealing edge disposed around its periphery and being connected to a source of vacuum, said method comprising the steps of forming a flat vent passage within said bag, disposed at one peripheral location on said bag with one half of said vent passage being made up of material from one portion of said bag, and the other half of said vent passage made up of a precisely equal amount of material from an opposite portion of said bag, such that the interior surfaces of said vent passage can tend to adhere together, said bag being entirely closed except for said vent passage, placing said thermoplastic bag in a supportive device having a desired configuration, placing said vacuum dome over said vent passage so said vent passage protrudes into the interior of said vacuum dome, with the peripheral edge of said dome in contact with bag portions surrounding said vent passage, reducing the pressure inside said dome, so as to cause the egress of air from the interior of said bag out through said vent passage, thereafter removing the source of vacuum from said come, and then removing said dome from contact with said bag, with the sidewalls of said vent member sealing together temporarily without letting the air back in, as a result of such precisely equal amounts of material, and then taking the final step of heat sealing the opening of said vent passage together, to effectively prevent the return of air to the interior of said bag.

2. The method as recited in claim 1 in which said dome is made in two substantially equal, closely interfitting parts, such that said vent passage need not be distinctly separated from the adjacent parts of said thermoplastic bag.

3. The method as recited in claim 1 in which said bag has at least one corner in a location adjacent said vent, which corner is cut at such time as a sample is to be taken of the contents of the bag, such corner, after the sample has been taken, is resealed, and the vacuum procedure repeated, using the vacuum dome.

4. The method of vacuum packaging products involving the use of heat sealable thermoplastic bag utilized in conjunction with a vacuum dome having a sealing edge disposed around its periphery and being connected to a source of vacuum, said thermoplastic bag being open at one end, and having an integral flat vent passage disposed at the opposite end, whose opposing interior surfaces utilizing equal amounts of material, which surfaces, tent to adhere together, said method comprising the steps of placing said thermoplastic bag in an inverted position in a supportive device having a desired configuration, with said vent passage pointed downwardly, and the open end of the bag pointed upwardly, filling the bag from its open end, sealing shut the open end, re-inverting the bag so its vent passage points upwardly, placing said vacuum dome over said vent passage so said vent passage protrudes into the interior of said vacuum dome, with the peripheral edge of said dome in contact with bag portions surrounding said vent passage, reducing the pressure inside said dome, so as to cause the egress of air from the interior of said bag out through said vent passage, thereafter removing the source of vacuum from said dome, and the removing said dome from contact with said bag, with the sidewalls of said vent member sealing together temporarily without letting the air back in, as a result of such use of equal amounts of material, and then taking the final step of heat sealing the opening of said vent passage together, to effectively prevent the return of air to the interior of said bag.

5. The method as recited in claim 4 in which said dome is made in two substantially equal, closely interfitting parts, such that said vent passage need not be distinctly separated from the adjacent parts of said thermoplastic bag.

6. The method as recited in claim 4 in which said bag has at least one corner in a location adjacent said vent, which corner is cut at such time as a sample is to be taken of the contents of the bag, such corner, after the sample has been taken, is resealed, and the vacuum procedure repeated, utilizing the vacuum dome.

7. The method of vacuum packaging products involving a heart sealable thermoplastic bag utilized in conjunction with a vacuum dome having a sealing edge disposed around its periphery and being connected to a source of vacuum, said method comprising the steps of placing a thermoplastic bag having an open end in a supportive device having a desired configuration, with the open end of the bag directed upwardly; filling the bag through its open end; thereafter clamping a fixture containing electric heating wires over the pair of edges constituting the open end of the bag, and using therewith spreader means to spread the open end of the bag; said wires being configured in such a manner as to create when current flows through the wires, a vent passage at the top of the bag, sealing said open end of the bag with said wires to form said vent passage, with the sidewalls of said vent passage, by virtue of the spreader means, being constituted by equal portions of material, so that they ten to adhere together; upon removal of the fixture, placing said vacuum dome over the newly formed vent passage so said vent passage protrudes into the interior of said vacuum dome, with the peripheral edge of said dome in contact with bag portions surrounding said vent passages; reducing the pressure inside said dome, so as to cause the egress of air from the interior of said bag out through said vent passage; thereafter removing the source of vacuum from said dome, and then removing said dome from contact with said bag, with the sidewalls of said vent member sealing together temporarily without letting the air back in, as a result of such precisely equal portions of material; and then taking the final step of heat sealing the opening of said vent passage, to effectively prevent the return of air to the interior of said bag.

8. The method as recited in claim 7 in which said dome is made in two substantially equal, closely interfitting parts, such that said vent passage need not be distinctly separated from the adjacent parts of said thermoplastic bag.

9. The method as recited in claim 7 in which said bag has at least one corner in a location adjacent said vent, which corner is cut at such time as a sample is to be taken of the contents of the bag, such corner, after the sample has been taken, is resealed, and the vacuum procedure repeated, utilizing the vacuum dome.

* * * * *